US006805431B2

(12) United States Patent
Anderson et al.

(10) Patent No.: US 6,805,431 B2
(45) Date of Patent: Oct. 19, 2004

(54) HEATER CHIP WITH DOPED DIAMOND-LIKE CARBON LAYER AND OVERLYING CAVITATION LAYER

(75) Inventors: Frank Edward Anderson, Sadieville, KY (US); Byron V Bell, Paris, KY (US); Yimin Guan, Lexington, KY (US); George Keith Parish, Winchester, KY (US); Robert Cornell, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 68 days.

(21) Appl. No.: 10/334,109

(22) Filed: Dec. 30, 2002

(65) Prior Publication Data

US 2004/0125174 A1 Jul. 1, 2004

(51) Int. Cl.[7] ..... B41J 2/05
(52) U.S. Cl. ..... 347/64
(58) Field of Search ..... 347/64, 203; 427/122, 427/249, 534, 563, 562, 577, 575, 527, 255.1

(56) References Cited

U.S. PATENT DOCUMENTS 4,335,389 A * 6/1982 Shirato et al. ..... 347/64
4,392,907 A * 7/1983 Shirato et al. ..... 156/252
4,663,640 A 5/1987 Ikeda (List continued on next page.)

FOREIGN PATENT DOCUMENTS

EP 0906828 A2 7/1999
WO WO 99/46128 A1 9/1999

OTHER PUBLICATIONS

Gluche, Leuner, Kohn, Rembe, Aus Der Wiesche, & Hofer, "Novel Thermal Microactuators Based on CVD Diamond Films," IEEE.

Gluch, Leuner, Vescan, Ebert, Kohn, Rembe, Aus Der Wiesche, & Hofer, "Actulator–sensor technology on "electronic grade" diamond films," Microsystems Technologies.

Hofer, Maier, Rembe, Aus Der Wiesche, Kohn, Adamschik, & Gluche, "A New Diamond Micro Heater for Inkjet Printheads," IS&T NIP, (Mar. 31, 1998).

Hofer, Maier, Rembe, Aus Der Wiesche, Kohn & Adamschik, "Realistic Performance Tests of a Diamond Printhead by High Speed Visualization," IS&T NIP.

J. Stasiak, "IBM Invention Disclosure," IBM.

*Primary Examiner*—Michael S. Brooke
(74) *Attorney, Agent, or Firm*—King & Schickli

(57) ABSTRACT

An inkjet printhead heater chip has a silicon substrate with a heater stack formed of a plurality of thin film layers thereon for ejecting an ink drop during use. The thin film layers include: a thermal barrier layer on the silicon substrate; a resistor layer on the thermal barrier layer; a doped diamond-like carbon layer on the resistor layer; and a cavitation layer on the doped diamond-like carbon layer. The doped diamond-like carbon layer preferably includes silicon but may also include nitrogen, titanium, tantalum, combinations thereof or other. When it includes silicon, a preferred silicon concentration ranges from 20 to 25 atomic percent. A preferred cavitation layer includes an undoped diamond-like carbon, tantalum or titanium layer. The doped diamond-like carbon layer ranges in thickness from 500 to 3000 angstroms. The cavitation layer ranges from 500 to 6000 angstroms. Inkjet printheads and printers are also disclosed.

21 Claims, 4 Drawing Sheets

U.S. PATENT DOCUMENTS

| | | | | |
|---|---|---|---|---|
| 4,956,653 | A | | 9/1990 | Braun |
| 4,990,939 | A | * | 2/1991 | Sekiya et al. ..... 347/62 |
| 5,157,419 | A | * | 10/1992 | Matsumoto et al. ..... 347/59 |
| ki5,348,909 | A | | 9/1994 | Stasiak |
| 5,559,367 | A | | 9/1996 | Cohen |
| 5,674,355 | A | | 10/1997 | Cohen |
| 5,744,865 | A | | 4/1998 | Jeng |
| 5,786,068 | A | | 7/1998 | Dorfman |
| 5,854,495 | A | | 12/1998 | Buhaenko |
| 5,933,166 | A | | 8/1999 | Andrews |
| 6,030,904 | A | | 2/2000 | Grill |
| 6,031,250 | A | | 2/2000 | Brandes |
| 6,046,758 | A | | 4/2000 | Brown |
| 6,080,470 | A | | 6/2000 | Dorfman |
| 6,139,131 | A | | 10/2000 | Prasad |
| 6,209,991 | B1 | | 4/2001 | Regan |
| 6,228,471 | B1 | | 5/2001 | Neerinck |
| 6,281,037 | B1 | | 8/2001 | Heera |
| 6,315,393 | B1 | | 11/2001 | Van Nice |
| 6,330,013 | B1 | | 12/2001 | Kashiwaya et al. |
| 6,346,747 | B1 | | 2/2002 | Grill |
| 6,412,924 | B1 | | 7/2002 | Ashe |
| 6,414,338 | B1 | | 7/2002 | Anderson |
| 6,505,914 | B2 | | 1/2003 | Hofer et al. |
| 6,558,563 | B2 | | 5/2003 | Kashiwaya et al. |
| 2002/0044174 | A1 | | 4/2002 | Hofer et al. |
| 2003/0081076 | A1 | * | 5/2003 | Park et al. ..... 347/65 |

* cited by examiner

HEATER CHIP WITH DOPED DIAMOND-LIKE CARBON LAYER AND OVERLYING CAVITATION LAYER

FIELD OF THE INVENTION

The present invention relates to inkjet printheads. In particular, it relates to a heater chip thereof having a doped diamond-like carbon layer above a resistor layer. More particularly, the doped diamond-like carbon layer includes silicon, nitrogen, titanium, tantalum or other and a cavitation layer of undoped diamond-like carbon, tantalum or titanium overlies the doped diamond-like carbon layer.

BACKGROUND OF THE INVENTION

The art of printing images with inkjet technology is relatively well known. In general, an image is produced by emitting ink drops from an inkjet printhead at precise moments such that they impact a print medium at a desired location. The printhead is supported by a movable print carriage within a device, such as an inkjet printer, and is caused to reciprocate relative to an advancing print medium. It emits ink drops at times pursuant to commands of a microprocessor or other controller. The timing of the ink drop emissions corresponds to a pattern of pixels of the image being printed. Other than printers, familiar devices incorporating inkjet technology include fax machines, all-in-ones, photo printers, and graphics plotters, to name a few.

Conventionally, a thermal inkjet printhead includes access to a local or remote supply of color or mono ink, a heater chip, a nozzle or orifice plate attached to the heater chip, and an input/output connector, such as a tape automated bond (TAB) circuit, for electrically connecting the heater chip to the printer during use. The heater chip, in turn, typically includes a plurality of thin film resistors or heaters fabricated by deposition, patterning and etching techniques on a substrate such as silicon. One or more ink vias cut or etched through a thickness of the silicon serve to fluidly connect the supply of ink to the individual heaters.

To print or emit a single drop of ink, an individual resistive heater is uniquely addressed with a small amount of current to rapidly heat a small volume of ink. This causes the ink to vaporize in a local ink chamber (between the heater and nozzle plate) and be ejected through and projected by the nozzle plate towards the print medium.

Heretofore, conventional heater chip thin films on a silicon substrate comprise silicon nitride (SiN) and silicon carbide (SiC) overlying a resistor layer for reasons relating to passivation. Thereafter, a cavitation layer overlies the two passivation layers to protect the heater from corrosive ink and bubble collapse occurring in the ink chamber. In terms of thickness, the SiN is often 2000 to 3000 angstroms, the SiC is 1000 to 1500 and the cavitation layer is 2000 to 4000 angstroms. Thus, at a minimum, the three combined layers above the resistor layer constitute a thickness of several thousand angstroms. Moreover, since all three layers have different chemical compositions, no less than three processing steps are required.

Accordingly, the inkjet printhead arts desire optimum heater chip configurations requiring minimum processing steps without suffering a corresponding sacrifice in printhead function or performance.

SUMMARY OF THE INVENTION

The above-mentioned and other problems become solved by applying the principles and teachings associated with the hereinafter described inkjet printhead heater chip having a doped diamond-like carbon thin film layer and overlying cavitation layer.

In one embodiment, a heater chip has a silicon substrate with a heater stack formed of a plurality of thin film layers thereon for ejecting an ink drop during use. The thin film layers include: a thermal barrier layer on the silicon substrate; a resistor layer on the thermal barrier layer; a doped diamond-like carbon layer on the resistor layer; and a cavitation layer on the doped diamond-like carbon layer. Together, the two doped diamond-like carbon and cavitation layers serve the tri-functions of enhanced adhesion, passivation and protection from cavitation. The doped diamond-like carbon layer preferably includes silicon but may also include nitrogen, titanium, tantalum or other. When it includes silicon, a preferred silicon concentration is about 20 to 25 atomic percent. More preferably, it is about 23 atomic percent. A preferred cavitation layer includes an undoped diamond-like carbon, tantalum or titanium layer. The doped diamond-like carbon layer ranges in thickness from 500 to 3000 angstroms. The cavitation layer ranges from 500 to 6000 angstroms. Thus, the combined thicknesses can range from as few as 1000 angstroms to 9000 angstroms.

In another aspect of the invention, the doped diamond-like carbon layer becomes formed on a substrate in a conventional PECVD chamber with a 200 to 1000 volt bias between the substrate and gas plasma. Preferably, the gas plasma includes methane and tetramethylsilane gasses.

In still another aspect, printheads containing the heater chip and printers containing the printhead are disclosed.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION OF THE PREFERRED EMBODIMENTS

In the following detailed description of the preferred embodiments, reference is made to the accompanying drawings that form a part hereof, and in which is shown by way of illustration, specific embodiments in which the inventions may be practiced. These embodiments are described in sufficient detail to enable those skilled in the art to practice the invention, and it is to be understood that other embodiments may be utilized and that process, electrical or mechanical changes may be made without departing from the scope of the present invention. The term wafer or substrate used in this specification includes any base semiconductor structure such as silicon-on-sapphire (SOS)

technology, silicon-on-insulator (SOI) technology, thin film transistor (TFT) technology, doped and undoped semiconductors, epitaxial layers of silicon supported by a base semiconductor structure, as well as other semiconductor structures well known to one skilled in the art. The following detailed description is, therefore, not to be taken in a limiting sense, and the scope of the present invention is defined only by the appended claims and their equivalents. In accordance with the present invention, we hereinafter describe an inkjet printhead heater chip having a doped diamond-like carbon thin film layer and an overlying cavitation layer.

Figure 1:
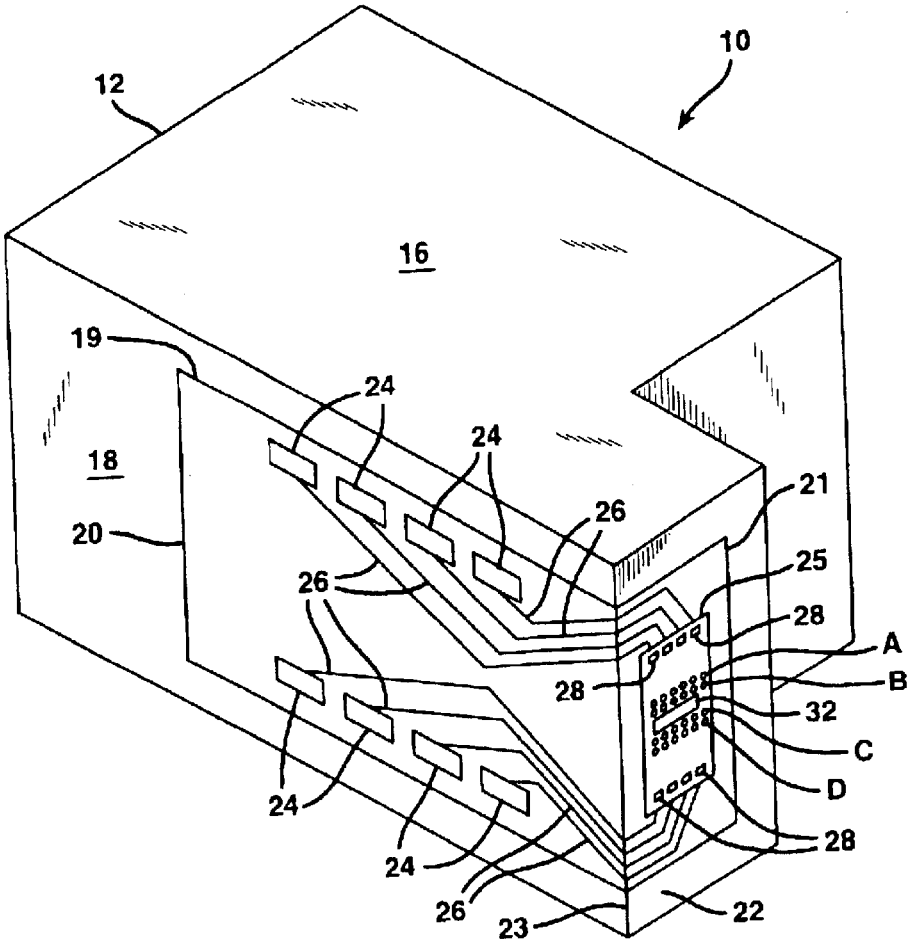
FIG. 1 is a perspective view in accordance with the teachings of the present invention of an inkjet printhead having a heater chip with a doped diamond-like carbon and overlying cavitation layer.

With reference to FIG. 1, an inkjet printhead of the present invention is shown generally as 10. The printhead 10 has a housing 12 formed of any suitable material for holding ink. Its shape can vary and often depends upon the external device that carries or contains the printhead. The housing has at least one compartment 16 internal thereto for holding an initial or refillable supply of ink. In one embodiment, the compartment has a single chamber and holds a supply of black ink, photo ink, cyan ink, magenta ink or yellow ink. In other embodiments, the compartment has multiple chambers and contains three supplies of ink. Preferably, it includes cyan, magenta and yellow ink. In still other embodiments, the compartment contains plurals of black, photo, cyan, magenta or yellow ink. It will be appreciated, however, that while the compartment 16 is shown as locally integrated within a housing 12 of the printhead, it may alternatively connect to a remote source of ink and receive supply from a tube, for example.

Adhered to one surface 18 of the housing 12 is a portion 19 of a flexible circuit, especially a tape automated bond (TAB) circuit 20. The other portion 21 of the TAB circuit 20 is adhered to another surface 22 of the housing. In this embodiment, the two surfaces 18, 22 are perpendicularly arranged to one another about an edge 23 of the housing.

The TAB circuit 20 supports a plurality of input/output (I/O) connectors 24 thereon for electrically connecting a heater chip 25 to an external device, such as a printer, fax machine, copier, photo-printer, plotter, all-in-one, etc., during use. Pluralities of electrical conductors 26 exist on the TAB circuit 20 to electrically connect and short the I/O connectors 24 to the input terminals (bond pads 28) of the heater chip 25 and those skilled in the art know various techniques for facilitating such connections. In a preferred embodiment, the TAB circuit is a polyimide material and the electrical conductors and connectors comprise copper. For simplicity, FIG. 1 only shows eight I/O connectors 24, eight electrical conductors 26 and eight bond pads 28 but present day printheads have much larger quantities and any number is equally embraced herein. Still further, those skilled in the art should appreciate that while such number of connectors, conductors and bond pads equal one another, actual printheads may have unequal numbers.

The heater chip 25 contains at least one ink via 32 that fluidly connects to a supply of ink internal to the housing. During printhead manufacturing, the heater chip 25 preferably connects or attaches to the housing with any of a variety of adhesives, epoxies, etc. well known in the art. To form the vias, many processes are known that cut or etch the via through a thickness of the heater chip. Some of the more preferred processes include grit blasting or etching, such as wet, dry, reactive-ion-etching, deep reactive-ion-etching, or other. As shown, the heater chip contains four columns (column A- column D) of fluid firing elements or heaters. For simplicity in this crowded figure, four columns of six dots depict the heaters but in practice the heaters may number several hundred or thousand. Vertically adjacent ones of the fluid firing elements may or may not have a lateral spacing gap or stagger there between. In general, however, the fluid firing elements have vertical pitch spacing comparable to the dots-per-inch resolution of an attendant printer. Some examples include spacing of $1/300^{th}$, $1/600^{th}$, $1/1200^{th}$, $1/2400^{th}$ or other of an inch along the longitudinal extent of the via. As described below in greater detail, it will be appreciated that the individual heaters of the heater chip preferably become formed as a series of thin film layers made via growth, deposition, masking, patterning, photolithography and/or etching or other processing steps. A nozzle plate with pluralities of nozzle holes, not shown, adheres or is fabricated as another thin film layer such that the nozzle holes align with and above the heaters. During use, the nozzle holes project the ink towards a print medium.

Figure 2:
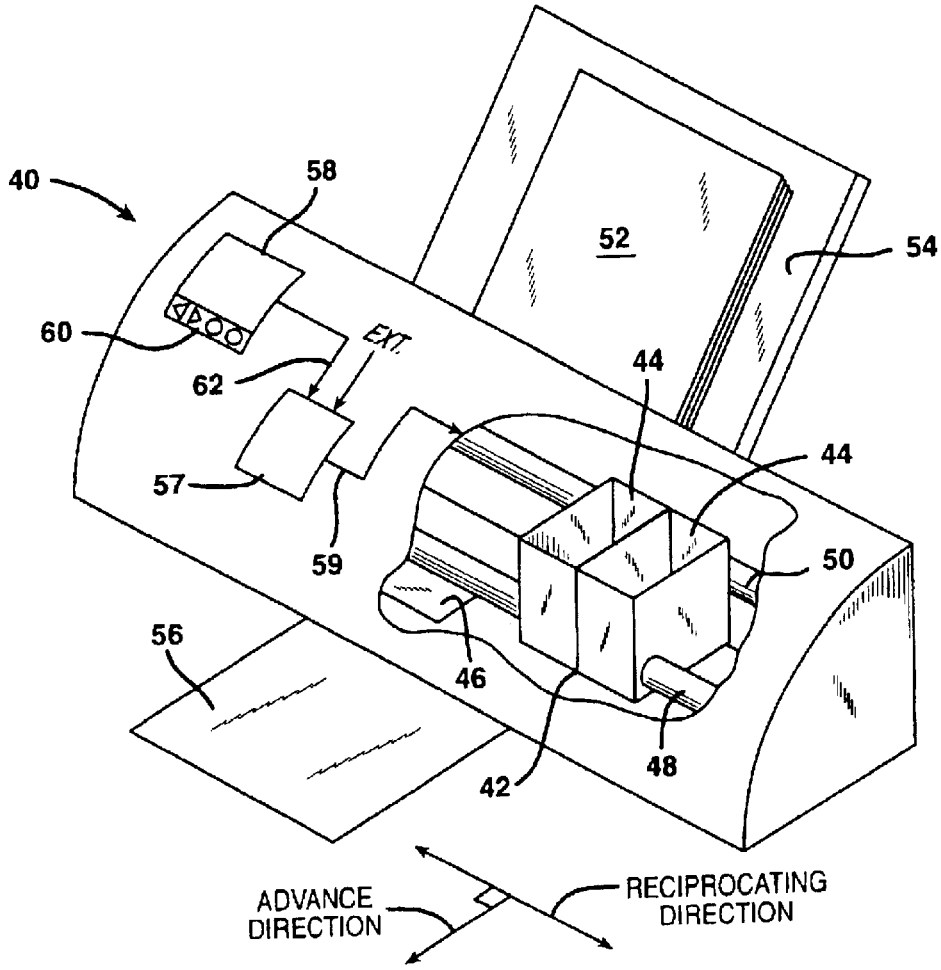
FIG. 2 is a perspective view in accordance with the teachings of the present invention of an inkjet printer for containing the inkjet printhead.

With reference to FIG. 2, an external device in the form of an inkjet printer contains the printhead 10 during use and is shown generally as 40. The printer 40 includes a carriage 42 having a plurality of slots 44 for containing one or more printheads 10. The carriage 42 reciprocates (in accordance with an output 59 of a controller 57) along a shaft 48 above a print zone 46 by a motive force supplied to a drive belt 50 as is well known in the art. The reciprocation of the carriage 42 occurs relative to a print medium, such as a sheet of paper 52 that advances in the printer 40 along a paper path from an input tray 54, through the print zone 46, to an output tray 56.

While in the print zone, the carriage 42 reciprocates in the Reciprocating Direction generally perpendicularly to the paper 52 being advanced in the Advance Direction as shown by the arrows. Ink drops from compartment 16 (FIG. 1) are caused to be eject from the heater chip 25 at such times pursuant to commands of a printer microprocessor or other controller 57. The timing of the ink drop emissions corresponds to a pattern of pixels of the image being printed. Often times, such patterns become generated in devices electrically connected to the controller 57 (via Ext. input) that reside externally to the printer and include, but are not limited to, a computer, a scanner, a camera, a visual display unit, a personal data assistant, or other.

To print or emit a single drop of ink, the fluid firing elements (the dots in columns A–D, FIG. 1) are uniquely addressed with a small amount of current to rapidly heat a small volume of ink. This causes the ink to vaporize in a local ink chamber between the heater and the nozzle plate and eject through, and become projected by, the nozzle plate towards the print medium. The fire pulse required to emit such ink drop may embody a single or a split firing pulse and is received at the heater chip on an input terminal (e.g., bond pad 28) from connections between the bond pad 28, the electrical conductors 26, the I/O connectors 24 and controller 57. Internal heater chip wiring conveys the fire pulse from the input terminal to one or many of the fluid firing elements.

A control panel 58, having user selection interface 60, also accompanies many printers as an input 62 to the controller 57 to provide additional printer capabilities and robustness.

Figure 3A:
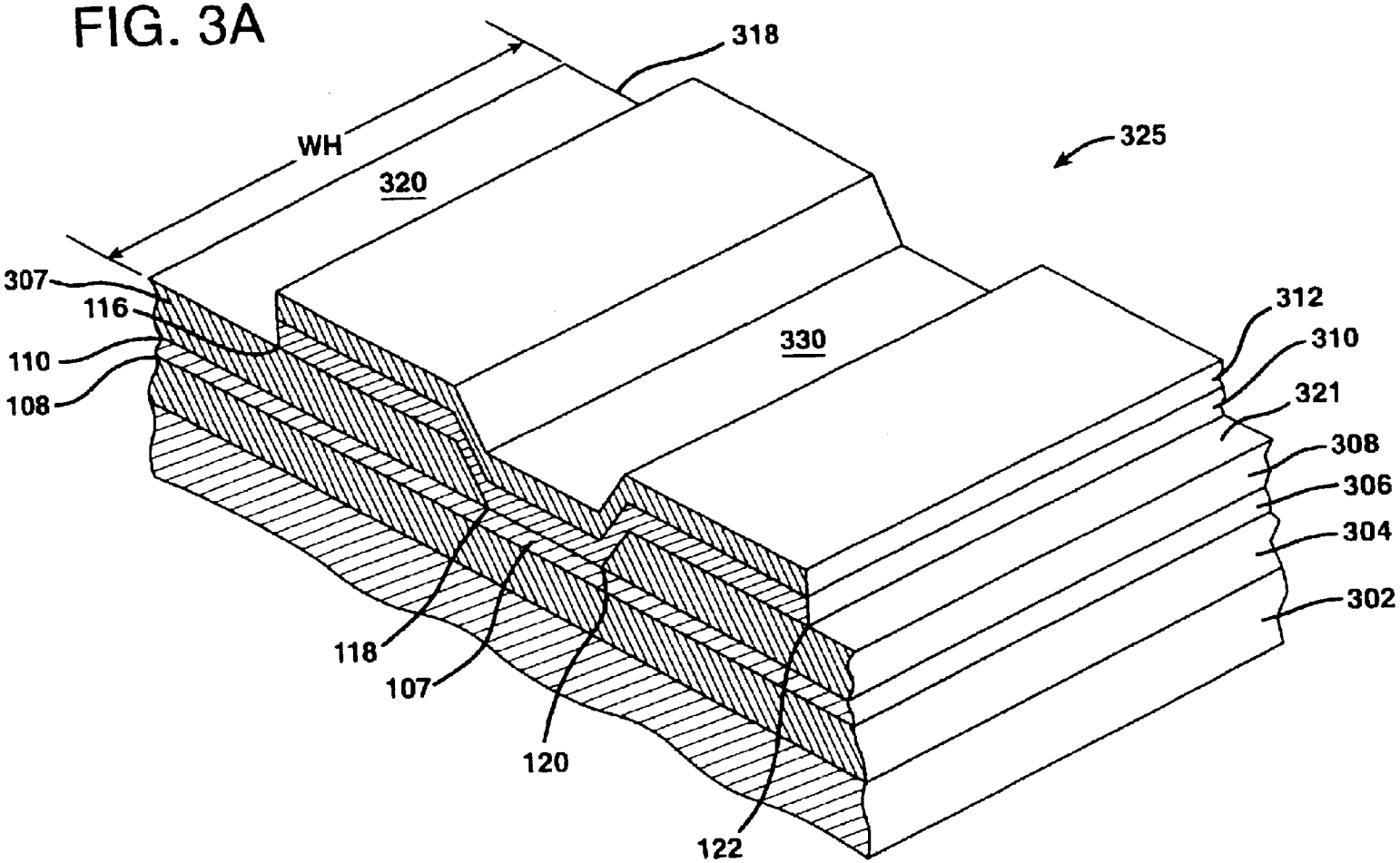
FIG. 3A is a perspective view in accordance with the teachings of the present invention of a heater stack of a heater chip having a doped diamond-like carbon and overlying cavitation layer.
Figure 3B:
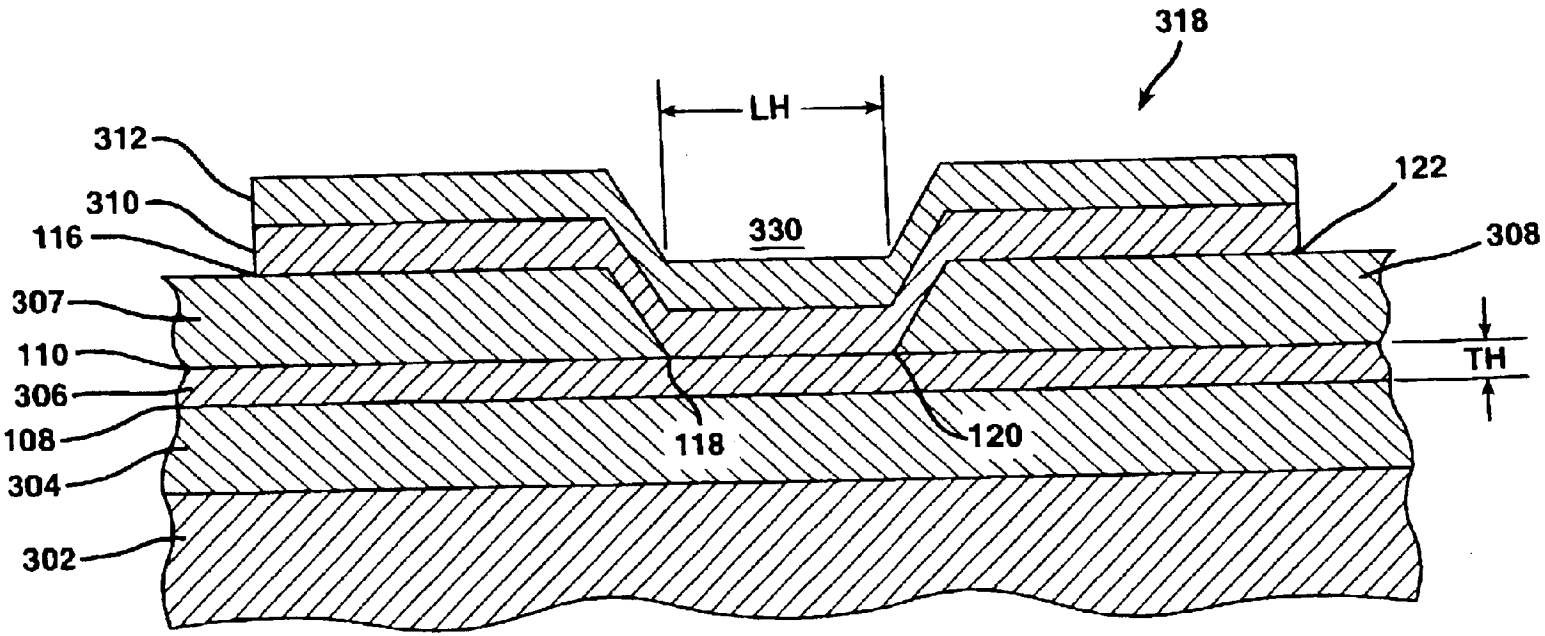
FIG. 3B is a planar view in accordance with the teachings of the present invention of a heater stack of a heater chip having a doped diamond-like carbon and overlying cavitation layer.

With reference to FIGS. 3A and 3B, appreciating the heater chip of the present invention is a substrate having been processed through a series of growth layers, deposition, masking, patterning, photolithography, and/or etching or other processing steps, a resulting heater chip 325 shown as a single heater stack 318 has a multiplicity of thin film layers stacked upon one another. Specifically, the thin film layers include, but are not limited to: a thermal barrier layer 304 on a substrate 302; a resistor layer 306 on the thermal barrier layer; a conductor layer (bifurcated into positive and negative electrode sections, i.e., anode 307, cathode 308) on the resistor layer to heat the resistor layer through thermal conductivity during use; a doped diamond-like carbon layer 310 on the resistor layer, and a cavitation layer 312 on the doped diamond-like carbon layer.

In various embodiments, the thin film layers become deposited by any variety of chemical vapor depositions (CVD), physical vapor depositions (PVD), epitaxy, ion beam deposition, evaporation, sputtering or other similarly known techniques. Preferred CVD techniques include low pressure (LP), atmospheric pressure (AP), plasma enhanced (PE), high density plasma (HDP) or other. Preferred etching techniques include, but are not limited to, any variety of wet or dry etches, reactive ion etches, deep reactive ion etches, etc. Preferred photolithography steps include, but are not limited to, exposure to ultraviolet or x-ray light sources, or other, and photomasking includes photomasking islands and/or photomasking holes. The particular embodiment, island or hole, depends upon whether the configuration of the mask is a clear-field or dark-field mask as those terms as well understood in the art.

As is apparent from FIGS. 3A and 3B, the substrate 302 provides the base layer upon which all other layers are formed. In one embodiment, it comprises a silicon wafer of p-type, 100 orientation, having a resistivity of 5–20 ohm/cm. Its beginning thickness is preferably, but not necessarily required, any one of 525+/−20 microns, 625+/−20 microns, or 625+/−15 microns with respective wafer diameters of 100+/−0.50 mm, 125 +/−0.50 mm, and 150+/−0.50 mm.

The next layer is a thermal barrier layer 304. Some embodiments of the layer include a silicon oxide layer mixed with a glass such as BPSG, PSG or PSOG with an exemplary thickness of about 1 to about 3 microns, especially 1.82+/−0.15 microns. This layer can be a grown layer as well as a deposited one.

Subsequent to the thermal barrier layer and disposed on a surface thereof is the heater or resistor layer 306. Preferably, the resistor layer is about a 50–50% tantalum-aluminum composition layer of about 1000 angstroms thick. In other embodiments, the resistor layer includes essentially pure or composition layers of any of the following: hafnium, Hf, tantalum, Ta, titanium, Ti, tungsten, W, hafnium-diboride, $HfB_2$, Tantalum-nitride, $Ta_2N$, TaAl(N,O), TaAlSi, TaSiC, Ta/TaAl layered resistor, Ti(N,O) and WSi(O).

A conductor layer overlies a portion of the resistor layer 306 (e.g., that portion of the resistor layer excluding the portion between points 118 and 120) and includes an anode 307 and cathode 308. In one embodiment, the conductor layer is about a 99.5–0.5% aluminum-copper composition of about 5000+/−10% angstroms thick. In other embodiments, the conductor layer includes pure or compositions of aluminum with 2% copper and aluminum with 4% copper.

On a surface of the resistor layer 306 between the anode and cathode (as between points 118 and 120) is a distance that defines a heater length LH. In an area 107 generally beneath the heater length, the resistor layer 306 has a thickness ranging from a surface 108 to a surface 10 that defines a resistor thickness. A width of the resistor layer 306 also defines a heater width, WH, as shown. As taught in co-pending Lexmark application Ser. No. 10/146,578, having a filing date of May 14, 2002, titled "Heater Chip Configuration for an Inkjet Printhead and Printer" and expressly incorporated herein by reference, the energy required to stably jet ink from an individual heater 318 is a function of heater area (heater width, WH, multiplied by heater length, LH) and thickness TH or heater volume. While the heater shape is generally depicted as having a square or rectangular shape, it is understood that other, more complex shapes may be used that are not described simply by a width WH and a length LH. However complex the heater shapes may be, they still have an area AH. The heater area AH is formed by the portion of the resistor layer 306 that is bounded between the anode 307 and the cathode 308. As a representative example, the invention contemplates jetting ink from a single heater with an energy/volume of about 3 to about 4 $GJ/m^3$. More particularly, it is about 2.94 to about 3.97 $GJ/m^3$. In turn, the power/volume is greater than about 1.5 $watts/m^3$. To produce 2 ng ink drops, the invention contemplates a heater area of about 300 $microns^2$ while 30 ng ink drops correspond to a heater area of about 1000 $microns^2$.

On a surface portion of the resistor layer 306, as between points 118 and 120, and along upper surface portions 320, 321 of the conductor layer, as between points 116 and 118 and between points 120 and 122, is a doped diamond-like carbon layer 310. In one embodiment, the doped diamond-like carbon layer ranges essentially uniformly in thickness from about 500 to about 3000 angstroms +/− about 10%. In another embodiment, the thickness is as large as about 8000 angstroms.

The dopant of the doped diamond-like carbon layer preferably includes silicon but may also include nitrogen, titanium, tantalum, a dielectric or other. When it includes silicon, a preferred silicon concentration is about 20 to 25 atomic percent. More preferably, it is about 23 atomic percent.

Among other things, it has been discovered that a single doped diamond-like carbon layer above the heater layer provides excellent passivation properties as compared to conventional heater chips with two passivation layers. Use of a single layer simplifies the manufacturing processing by eliminating a deposition step from the process flow and also improves process capability. It also exhibits enhanced adhesion to the underlying layer as compared to essentially pure diamond-like carbon. A description of a pure diamond-like carbon layer on a resistor layer can be found in Lexmark-assigned, co-pending application, Ser. No. 10/165,534, filed Jun. 7, 2002, titled "Energy Efficient Heater Stack Using DLC Island" which disclosure is incorporated herein by reference.

Unfortunately, a single layer of doped diamond-like carbon does not sufficiently withstand the corrosive effects of ink or the long-term bubble collapse effects in the area 330 generally above the heater. Thus, to improve longevity, a cavitation layer 312 is disposed on an upper surface of the doped diamond-like carbon layer. Together the two doped diamond-like carbon and cavitation layers serve the tri-functions of enhanced adhesion, passivation and cavitation.

In a preferred embodiment, the cavitation layer includes an undoped diamond-like carbon, pure or doped tantalum, pure or doped titanium or other layer. In another embodiment, the cavitation layer ranges essentially uniformly in thickness from about 500 to about 6000 angstroms. In turn, the combined thicknesses of the doped diamond-like carbon layer and the cavitation layer ranges from as few as 1000 angstroms to 9000 angstroms. Actual thicknesses, however, depends upon application.

A nozzle plate, not shown, is eventually attached to the foregoing described heater stack to direct and project ink drops, formed as bubbles in the ink chamber area 330 generally above the heater, onto a print medium during use.

In another aspect of the invention, the doped diamond-like carbon layer becomes formed on the substrate 302 in a conventional PECVD chamber with about a 200 to about 1000 volt bias between the substrate and gas plasma. Preferably, the gas plasma includes methane and tetramethylsilane gasses. Thereafter, in the event the cavitation layer is an undoped diamond-like carbon layer, the flow of tetramethylsilane gas to the chamber can be shut off thereby allowing pure diamond-like carbon to plate or build up. This saves processing steps.

In other embodiments, the diamond-like carbon layer is deposited at a pressure of about 30 mtorr using a power density of about 30 to 35 $KW/m^2$ with a deposition rate of about 1000 to 2000 angstroms/minute.

Finally, the foregoing description is presented for purposes of illustration and description of the various aspects of the invention. The descriptions are not intended, however, to be exhaustive or to limit the invention to the precise form disclosed. Accordingly, the embodiments described above were chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A heater chip for an inkjet printhead, comprising:

a substrate;

a resistor layer on the substrate;

a doped diamond-like carbon layer directly on the resistor layer; and a cavitation layer on the doped diamond-like carbon layer.

2. The heater chip of claim 1, wherein the doped diamond-like carbon layer is a silicon diamond-like carbon layer.

3. The heater chip of claim 2, wherein a silicon concentration in the silicon diamond-like carbon layer is about 20 to about 25 atomic percent.

4. A heater chip for an inkjet printhead, comprising:

a substrate;

a resistor layer on the substrate;

an anode and a cathode on the resistor layer; and a doped diamond-like carbon layer directly on the resistor layer between the anode and the cathode.

5. A heater chip for an inkjet printhead, comprising:

a substrate;

a resistor layer on the substrate;

a doped diamond-like carbon layer directly on a surface portion of the resistor layer; and a cavitation layer directly on the doped diamond-like carbon layer.

6. The heater chip of claim 5, wherein the cavitation layer is one of an undoped diamond-like carbon layer, a tantalum layer and a titanium layer.

7. The heater chip of claim 6, wherein the cavitation layer is about 500 to about 6000 angstroms thick.

8. The heater chip of claim 5, wherein the doped diamond-like carbon layer includes silicon.

9. The heater chip of claim 8, wherein a silicon concentration in the doped diamond-like carbon layer is about 20 to about 25 atomic percent.

10. The heater chip of claim 5, wherein the doped diamond-like carbon layer is about 500 to about 3000 angstroms thick.

11. The heater chip of claim 5, wherein the doped diamond-like carbon layer includes one of nitrogen, titanium, tantalum and a dielectric.

12. An inkjet printhead, comprising:

a housing;

a substrate connected to the housing;

a resistor layer on the substrate;

a silicon doped diamond-like carbon layer of about 500 to about 3000 angstroms thick directly on the resistor layer; and one of an undoped diamond-like carbon layer, a tantalum layer and a titanium layer of about 500 to about 6000 angstroms thick directly on the silicon diamond-like carbon layer.

13. The printhead of claim 12, wherein a silicon concentration in the silicon diamond-like carbon layer is about 20 to about 25 atomic percent.

14. The printhead of claim 12, further including a supply of ink in the housing.

15. A heater chip heater stack for an inkjet printhead, consisting essentially of:

a substrate;

a thermal barrier layer on the substrate;

a resistor layer on the substrate;

a conductor layer on the substrate, the conductor layer having an anode and a cathode;

a doped diamond-like carbon layer directly on a surface portion of the resistor layer between the anode and the cathode, the doped diamond-like carbon layer having a substantially homogeneous composition throughout a thickness thereof; and a cavitation layer on the doped diamond-like carbon layer, wherein the substrate lacks a silicon carbide and a silicon nitride layer.

16. The heater chip heater stack of claim 15, wherein the doped diamond-like carbon layer is a silicon diamond-like carbon layer.

17. The heater chip heater stack of claim 15, wherein the cavitation layer is one of an undoped diamond-like carbon layer, a tantalum layer and a titanium layer.

18. The heater chip heater stack of claim 15, wherein the doped diamond-like carbon layer includes one of nitrogen, titanium, tantalum and a dielectric.

19. The heater chip heater stack of claim 15, wherein the resistor layer is a tantalum-aluminum layer.

20. An inkjet printhead, comprising:

a housing with an initial supply of ink; and a silicon substrate connected with the housing having a heater stack formed of a plurality of thin film layers thereon for ejecting an ink drop from the supply of ink during use, the thin film layers including a thermal barrier layer directly on the silicon substrate having a thickness of about 1 to about 3 microns;

a tantalum-aluminum resistor layer directly on the thermal barrier layer having a thickness of about 1000 angstroms;

a silicon doped diamond-like carbon layer directly on a portion of the tantalum-aluminum resistor layer having a thickness of about 500 to about 3000 angstroms, a silicon concentration of the silicon diamond-like carbon layer being about 20 to about 25 atomic percent; and a cavitation layer directly on the silicon diamond-like carbon layer having a thickness of about 500 to about 6000 angstroms.

21. The printhead of claim 20, wherein the cavitation layer is one of an undoped diamond-like carbon layer, a tantalum layer and a titanium layer.

* * * * *